US011133569B2

(12) United States Patent
Kim et al.

(10) Patent No.: US 11,133,569 B2
(45) Date of Patent: Sep. 28, 2021

(54) COMPACT CONNECTOR FOR TRANSMITTING SUPER HIGH FREQUENCY SIGNAL

(71) Applicant: SENSORVIEW INCORPORATED, Gyeonggi-do (KR)

(72) Inventors: Byoung Nam Kim, Gyeonggi-do (KR); Kyoung Il Kang, Gyeonggi-do (KR); Sung Gyu Park, Gyeonggi-do (KR); Joung Min Park, Gyeonggi-do (KR); Sang Woo Han, Gyeonggi-do (KR); Ji Hun Kang, Gyeonggi-do (KR)

(73) Assignee: SENSORVIEW INCORPORATED, Gyeonggi-do (KR)

( * ) Notice: Subject to any disclaimer, the term of this patent is extended or adjusted under 35 U.S.C. 154(b) by 0 days.

(21) Appl. No.: 16/898,546

(22) Filed: Jun. 11, 2020

(65) Prior Publication Data

US 2020/0395653 A1 Dec. 17, 2020

(30) Foreign Application Priority Data

Jun. 14, 2019 (KR) ..... 10-2019-0071043
Nov. 13, 2019 (KR) ..... 10-2019-0145207

(51) Int. Cl.
*H01Q 1/24* (2006.01)
*H01Q 1/22* (2006.01)
(Continued)

(52) U.S. Cl.
CPC ..... *H01Q 1/2283* (2013.01); *H01Q 1/526* (2013.01); *H01Q 23/00* (2013.01)

(58) Field of Classification Search
CPC ..... H01Q 1/2283; H01Q 1/526; H01Q 23/00; H01R 13/6594; H01R 13/6582;
(Continued)

(56) References Cited

U.S. PATENT DOCUMENTS 6,623,302 B2 * 9/2003 Billman ..... H01R 12/716 439/607.07
7,156,678 B2 * 1/2007 Feldman ..... H01R 4/024 439/326
(Continued)

FOREIGN PATENT DOCUMENTS

WO WO-2008/123652 A1 10/2008

OTHER PUBLICATIONS

Extended European Search Report from corresponding European Patent Application No. 20179705.7, dated Nov. 10, 2020.

*Primary Examiner* — Jean B Jeanglaude
(74) *Attorney, Agent, or Firm* — Harness, Dickey & Pierce, P.L.C.

(57) ABSTRACT

A compact connector for transmitting super-high-frequency signals is adapted to connect a printed circuit board (PCB) to a single or multiple high-frequency signal lines transmitting super-high frequency signals therethrough. The compact connector includes: a male connector connected to the single or multiple super-high frequency signal lines and including a male connector housing receiving, securing, and protecting terminals of the single or multiple super-high frequency signal lines; and a connector socket mounted on the PCB and receiving the male connector housing fastened to the male connector, wherein the super high-frequency signal line terminals in the male connector are brought into direct contact with and connected to signal line terminal pads formed on the printed circuit board, respectively.

6 Claims, 8 Drawing Sheets

(51) Int. Cl.
*H01Q 1/52* (2006.01)
*H01Q 23/00* (2006.01)

(58) Field of Classification Search
CPC .. H01R 13/6591; H01R 12/598; H01R 24/50; H01R 12/716; H01R 9/0515; H01R 12/778; H01R 12/714; H01R 12/777; H01R 12/775; H01R 12/79; H01R 13/02; H01R 13/6275; H01R 12/7052; H01R 13/6581; H01R 13/6592
USPC ..... 343/702
See application file for complete search history.

(56) References Cited

U.S. PATENT DOCUMENTS

| | | | | |
|---|---|---|---|---|
| 8,743,556 | B2 * | 6/2014 | Hampo | H01R 12/71 361/775 |
| 9,450,345 | B2 * | 9/2016 | Weigand | H05K 1/118 |
| 2005/0095902 | A1 | 5/2005 | Zhang et al. | |
| 2006/0228952 | A1 | 10/2006 | Feldman et al. | |
| 2007/0042619 | A1 * | 2/2007 | Ferry | H01R 29/00 439/108 |
| 2014/0049292 | A1 * | 2/2014 | Popescu | G02B 6/43 327/100 |
| 2014/0187087 | A1 | 7/2014 | Mason et al. | |
| 2016/0218455 | A1 * | 7/2016 | Sayre | H01R 13/6594 |

* cited by examiner

COMPACT CONNECTOR FOR TRANSMITTING SUPER HIGH FREQUENCY SIGNAL

CROSS-REFERENCE TO RELATED APPLICATIONS

This application claims the benefit of Korean Patent Application Nos. 10-2019-0145207, filed on Nov. 13, 2019 and 10-2019-0071043 filed on Jun. 14, 2019, the entire disclosures of which are incorporated herein by references.

FIELD

The present invention relates to a connector for transmitting super-high frequency signals and, more particularly, to a compact connector for transmitting super-high frequency signals, which is adapted to connect a single or multiple super-high frequency signal lines to a printed circuit board (PCB), in which signal lines in a male connector of the compact connector are directly connected to signal line pads on the PCB.

BACKGROUND

FIG. 1 is a sectional view of a typical PCB mono- or multi-connector. In the PCB mono- or multi-connector, a male connector 112 including a male connector housing 112 covering a terminal of an electrical signal line 114 for transmitting electrical signals, such as a cable or a wire, is inserted into and connected to a female connector (or socket) 150 mounted on a PCB 160. Here, a female connector housing 152 of the female connector 150 is provided with a reception member 154 receiving the terminal (or pin) in the male connector.

However, such a typical PCB mono- or multi-connector has a problem in that leakage current is likely to occur through the reception member 154, causing signal loss, and there is a limit to miniaturization of the connector.

SUMMARY

Embodiments of the present invention have been conceived to solve such a problem of typical PCB mono- or multi-connectors and it is an aspect of the present invention to provide a compact connector for transmitting super-high frequency signals, which includes a female connector that includes only a housing socket mounted on a PCB and receiving a male connector housing without a separate terminal reception member for receiving terminals of a single or multiple super-high frequency signal lines in a male connector, such that the terminals in the male connector can be brought into direct contact with terminal pads on the PCB, thereby minimizing signal loss and allowing miniaturization through significant reduction in height of the connector.

In accordance with an aspect of the present invention, there is provided a compact connector for transmitting super-high-frequency signals, which is adapted to connect a printed circuit board (PCB) to a single or multiple high-frequency signal lines transmitting super-high frequency signals therethrough, the compact connector including: a male connector connected to the single or multiple super-high-frequency signal lines and including a male connector housing receiving, securing, and protecting terminals of the single or multiple super-high frequency signal lines; and a connector socket mounted on the PCB and receiving the male connector housing fastened to the male connector, wherein the super high-frequency signal line terminals in the male connector are brought into direct contact with and connected to signal line terminal pads formed on the printed circuit board, respectively.

The male connector housing may be a shielding can connected to shielding layers blocking electromagnetic waves generated from the single or multiple super-high frequency signal lines; and the connector socket may receive the shielding can and may be electrically connected to the shielding can and a ground terminal of the PCB. The male connector may further include an adapter allowing the super-high frequency signal lines to be brought into contact with the signal line terminal pads formed on the PCB, respectively, and connected at one end thereof to the super-high frequency signal lines and connected at the other end thereof to the circuit signal line terminal pads on the PCB, and the super-high frequency signal lines can be connected to the circuit signal line terminal pads on the printed circuit board via the adapter of the male connector.

The shielding can may include an adapter reception portion receiving a single or multiple adapters one-to-one connected to inner conductors of a single or multiple coaxial cables, the adapter reception portion being configured to individually shield the adapters. The connector socket may further include a fastening portion to be fastened to the male connector. The connector socket may be mounted on the PCB by surface-mount technology, through-hole-mount technology, such as single in-line package (SIP) technology, dual in-line package (DIP) technology, and quad in-line package (QIP) technology, or a combination of surface-mount technology and through-hole-mount technology.

In the compact connector for transmitting super high-frequency signals according to the present invention, a reception member typically provided to a connector socket to receive signal line terminals in a male connector is omitted such that the signal line terminals in the male connector can be bought into direct contact with signal line terminal pads on a PCB, or adapters adapted to receive ends of cable inner conductors are provided to allow easy contact between the signal line terminals in the male connector and the respective signal line terminal pads on the PCB, thereby minimizing leakage current and noise to reduce signal loss while allowing minimization of the connector through reduction in fastening height of the connector.

In addition, according to the present invention, when the signal lines are coaxial cables, outer conductors, which are shielding layers of the coaxial cables connected to the male connector, are connected to a shielding can blocking electromagnetic waves generated from inner conductors, which are signal lines of the coaxial cables, and the connector socket mounted on the PCB and connected to a ground terminal of the PCB is brought into contact with and electrically connected to the shielding can of the male connector by receiving the shielding can, thereby reducing signal loss in the signal line terminals in the male connector, which directly contact the circuit signal terminal pads on the PCB.

Further, according to the present invention, since it is possible to eliminate a separate reception member for receiving the signal line terminals in the male connector the connector socket, the structure of the connector socket can be simplified, thereby allowing reduction in manufacturing cost.

DETAILED DESCRIPTION

Hereinafter, embodiments of the present invention will be described with reference to the accompanying drawings. It will be understood that the embodiments and the drawings described in the specification are not exhaustive but solely illustrative and there are present various alterations and equivalent embodiments thereof at the time of filing the present application.

A compact connector for transmitting super-high frequency signals according to the present invention is a PCB connector which connects a printed circuit board (PCB) to a single or multiple super-high frequency signal lines for transmitting super-high frequency signals, and includes a male connector and a connector socket. The male connector is connected to the single or multiple super-high frequency signal lines and includes a male connector housing receiving terminals of the single or multiple super-high frequency signal lines to secure and protect the signal line terminals. The connector socket is mounted on the PCB and receives the male connector housing fastened to the male connector. Here, the super-high frequency signal line terminals in the male connector may be brought into direct contact with and connected to signal line terminal pads formed on the PCB, respectively.

Figure 1:
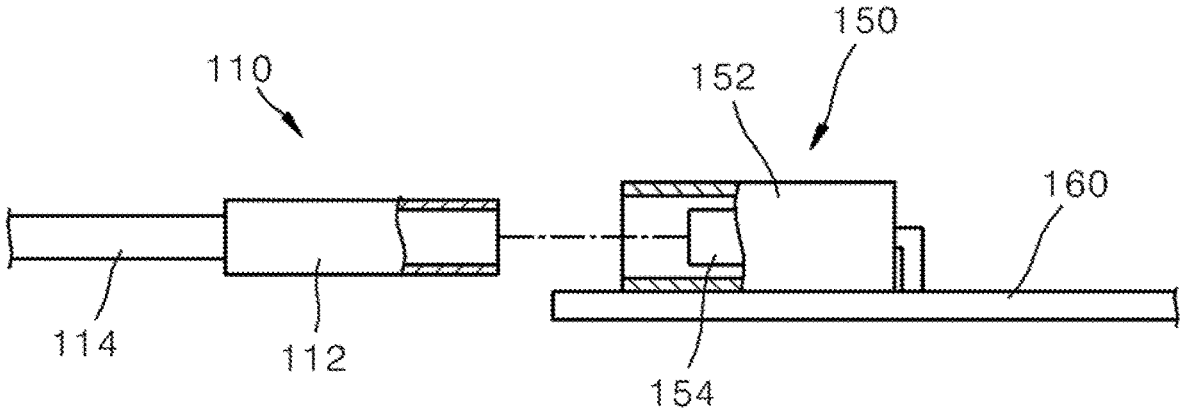
FIG. 1 is a side sectional view of a typical PCB multi-connector.
Figure 2:
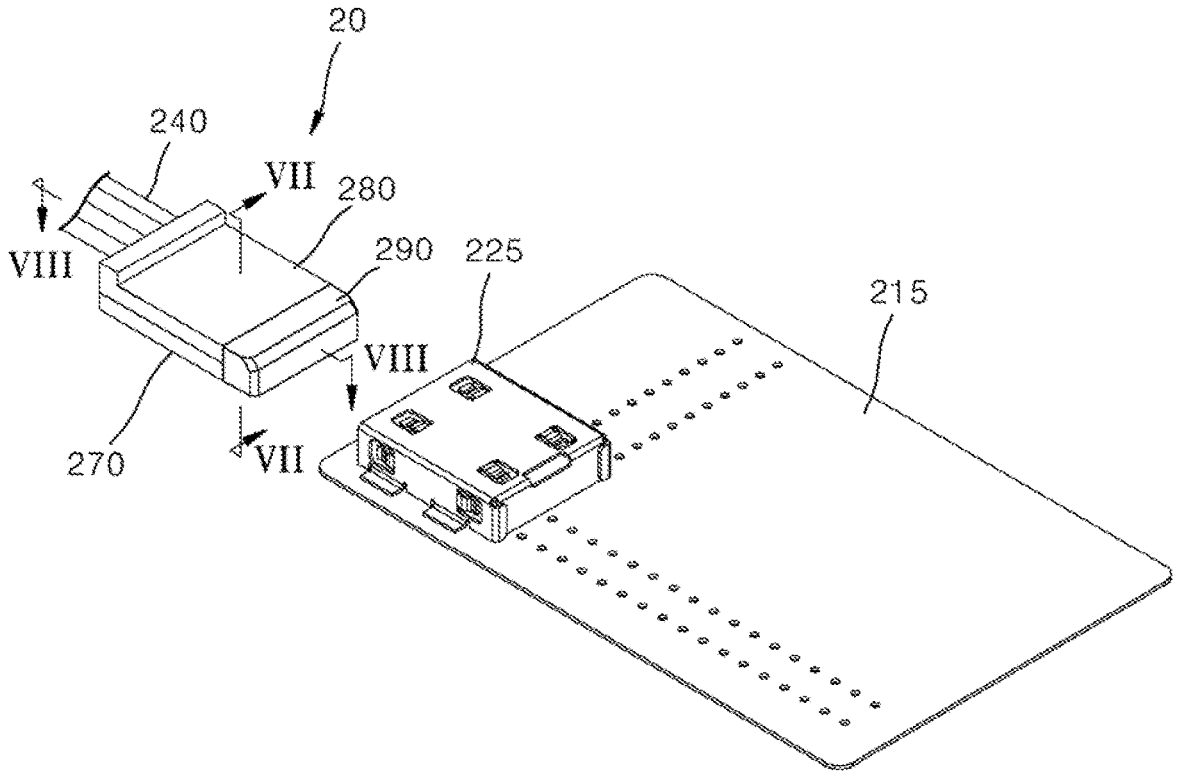
FIG. 2 is a view of an example of a compact connector for transmitting super-high frequency signals according to the present invention, with a male connector not fastened to a connector socket mounted on a PCB.
Figure 3:
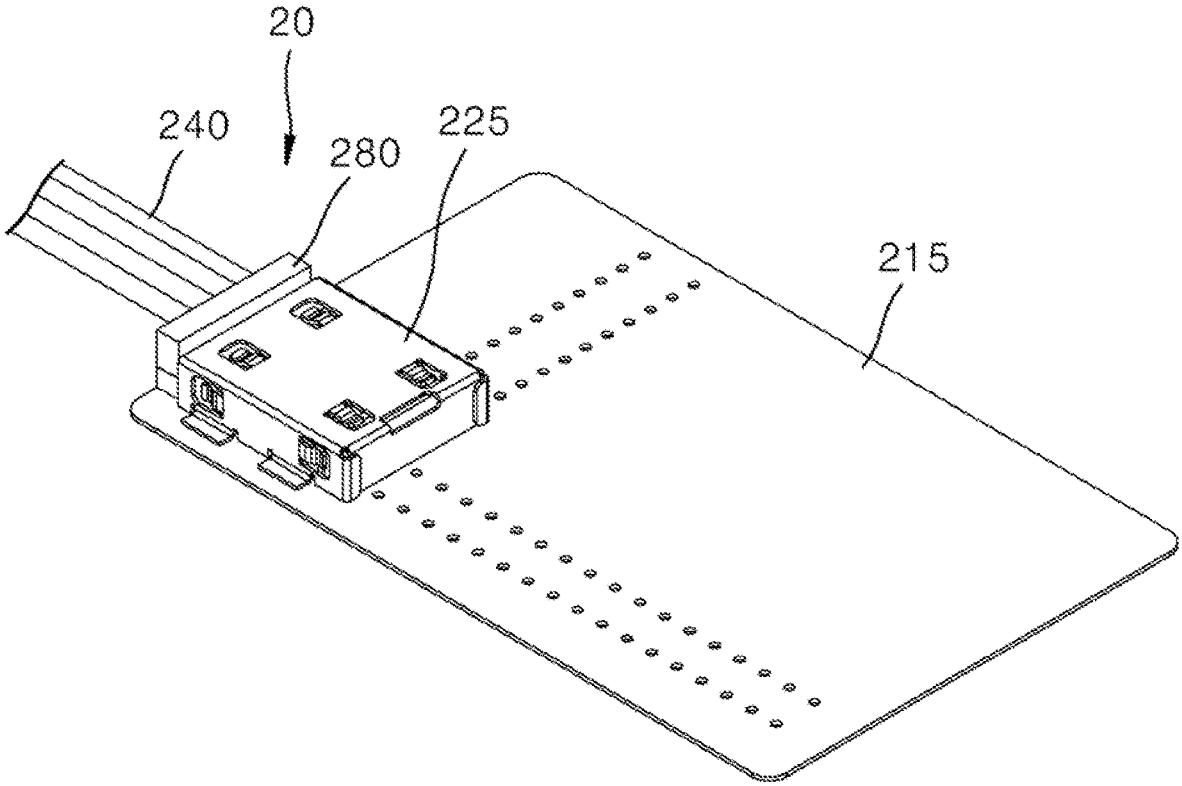
FIG. 3 is a view of the compact connector for transmitting super-high frequency signals according to the present invention, with the male connector fastened to the connector socket mounted on the PCB.

FIG. 2 is a view of an example of the compact connector for transmitting super-high frequency signals according to the present invention, with a male connector 20 not fastened to a connector socket 225 mounted on a PCB 215. FIG. 3 is a view of the PCB multi-connector according to the present invention, with the male connector 20 fastened to the connector socket 225 mounted on the PCB 215. Referring to FIG. 2 and FIG. 3, a housing 270, 280, 290 of the male connector connected to cables 240 is inserted into and fastened to the connector socket 225 mounted on the PCB 125. Here, connection between the PCB and the cables 240 is established by bringing cable terminals formed on a bottom surface of the male connector into direct contact with circuit signal line terminal pads formed on the PCB 215, respectively.

Figure 4:
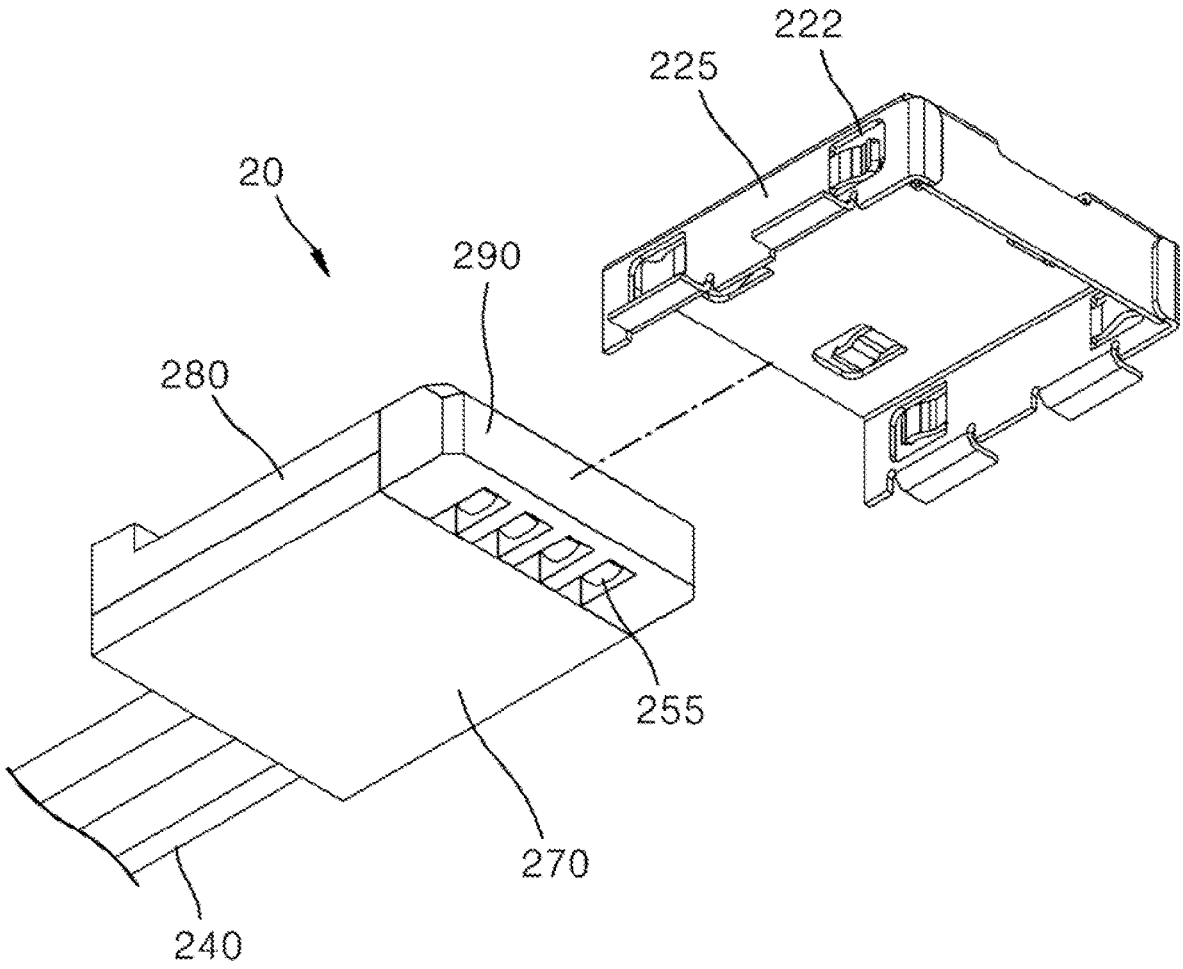
FIG. 4 is a bottom perspective view of the male connector and the connector socket of the compact connector for transmitting super-high frequency signals according to the present invention.
Figure 5:
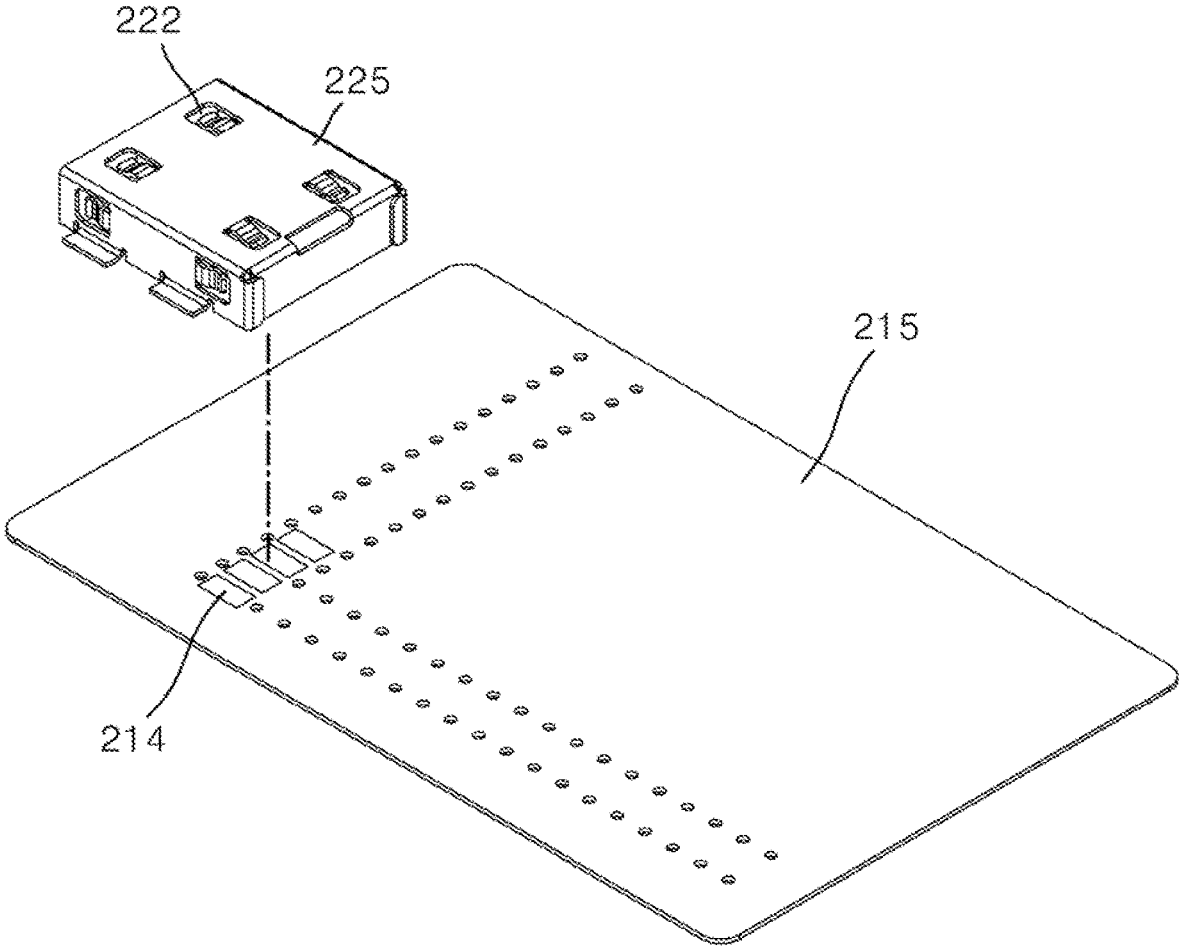
FIG. 5 is an exploded perspective view of an example of the connector socket of the compact connector for transmitting super-high frequency signals according to the present invention.

FIG. 4 is a bottom perspective view of the male connector 20 and the connector socket 225 of the compact connector for transmitting super-high frequency signals according to the present invention. FIG. 5 is an exploded perspective view of the compact connector for transmitting super-high frequency signals according to the present invention, showing the connector socket 225 and the PCB 215. Referring to FIG. 4 and FIG. 5, cable signal line terminals 255 are formed on a bottom surface of the male connector 20. The connector socket 225 may include a fastening portion 222 to be fastened to the male connector 20. The connector socket 225 may be mounted on the PCB 215 by surface-mount technology (SMT), through-hole-mount technology, such as single in-line package (SIP) technology, dual in-line package (DIP) technology, and quad in-line package QIP technology, or a combination of surface-mount technology and through-hole-mount technology. Alternatively, the connector socket 225 may be integrally formed with the PCB, rather than formed separately from the PCB.

When the housing 270, 280, 290 of the male connector 20 is inserted into and fastened to the connector socket 225 mounted on the PCB 125, the cable signal line terminals 255 are brought into direct contact with circuit signal line terminal pads 214 formed on the PCB 215, respectively, without using a separate reception member for receiving the cable signal line terminals 255. According to the present invention, since the connector socket 225 mounted on the PCB 125 is not provided with such a reception member for receiving the cable signal line terminals 255, as shown in FIG. 4, the structure of the connector socket can be simplified and the height at which the connector socket is fastened to the male connector can be minimized, thereby allowing miniaturization of the connector. The compact connector for transmitting super-high frequency signals according to the present invention can connect signal lines for transmitting electrical signals, such as RF signals and power supply signals, to the PCB or a power supply, and can be applied to various electronic devices requiring miniaturization of a related connector, such as tablet PCs, laptop PCs, 5G smartphones, and home appliances (for example, TVs, refrigerators, washing machines, and the like).

Figure 6:
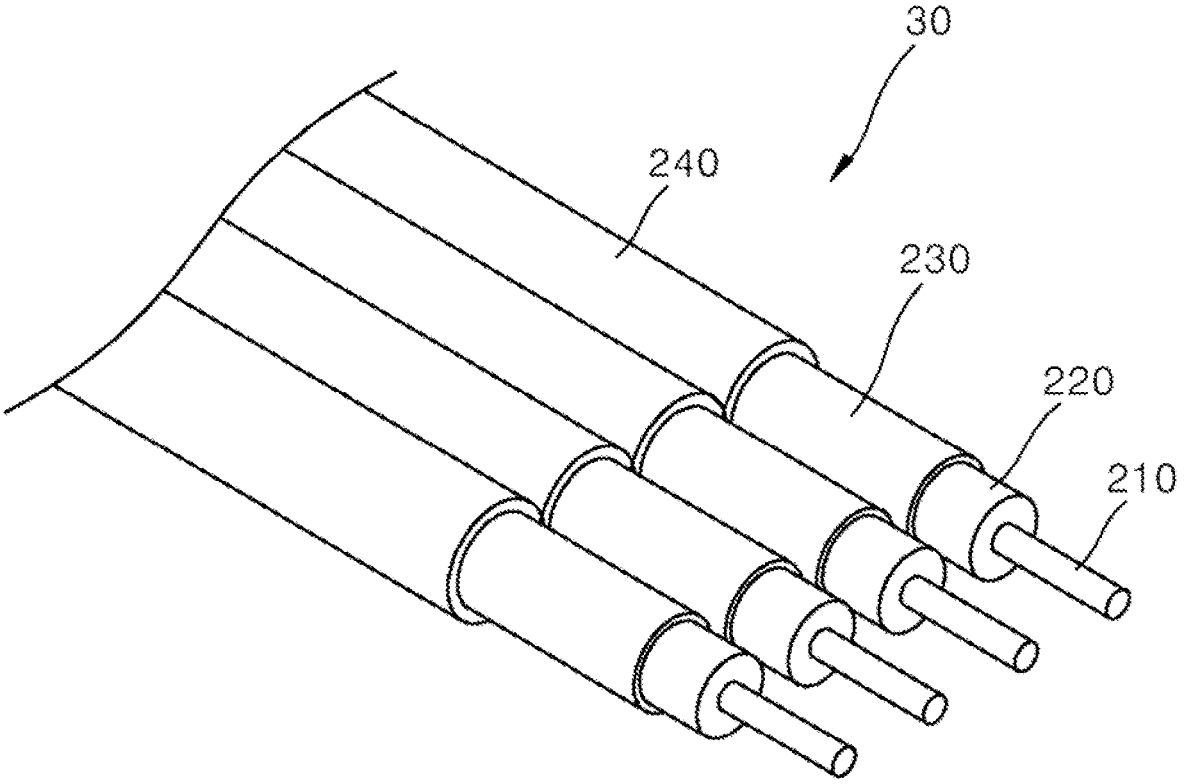
FIG. 6 is a view of exemplary components constituting the male connector of the compact connector for transmitting super-high frequency signals according to the present invention.

Examples of the single or multiple super-high frequency signal lines for transmitting super-high frequency signals, which are connected via the compact connector for transmitting super-high frequency signals according to the present invention, may include coaxial cables, wires, flexible flat cables (FFCs), flexible printed circuits (FPCs), S-Teflon, and the like. However, it will be understood that the present invention is not limited thereto and the super-high frequency signal lines may include any signal line that is adapted to transmit electrical signals therethrough. FIG. 6 is a view of coaxial cables 30 as exemplary electrical signal lines connected to the male connector 20 of the compact connector for transmitting super-high frequency signals according to the present invention. Referring to FIG. 6, each of the coaxial cables 30 includes an inner conductor 210 used as a signal line, an outer conductor 230 formed of aluminum, copper, or the like and blocking electromagnetic waves generated from the inner conductor 210, a dielectric 220 insulating and isolating the inner conductor 210 from the outer conductor 230, and a sheath (or jacket) protecting the outer conductor 230. The internal conductor may transmit various electrical signals, such as DC signals, microwave signals, and millimeter-wave signals, particularly, super-high frequency signals of about 50 GHz or more.

Figure 7:
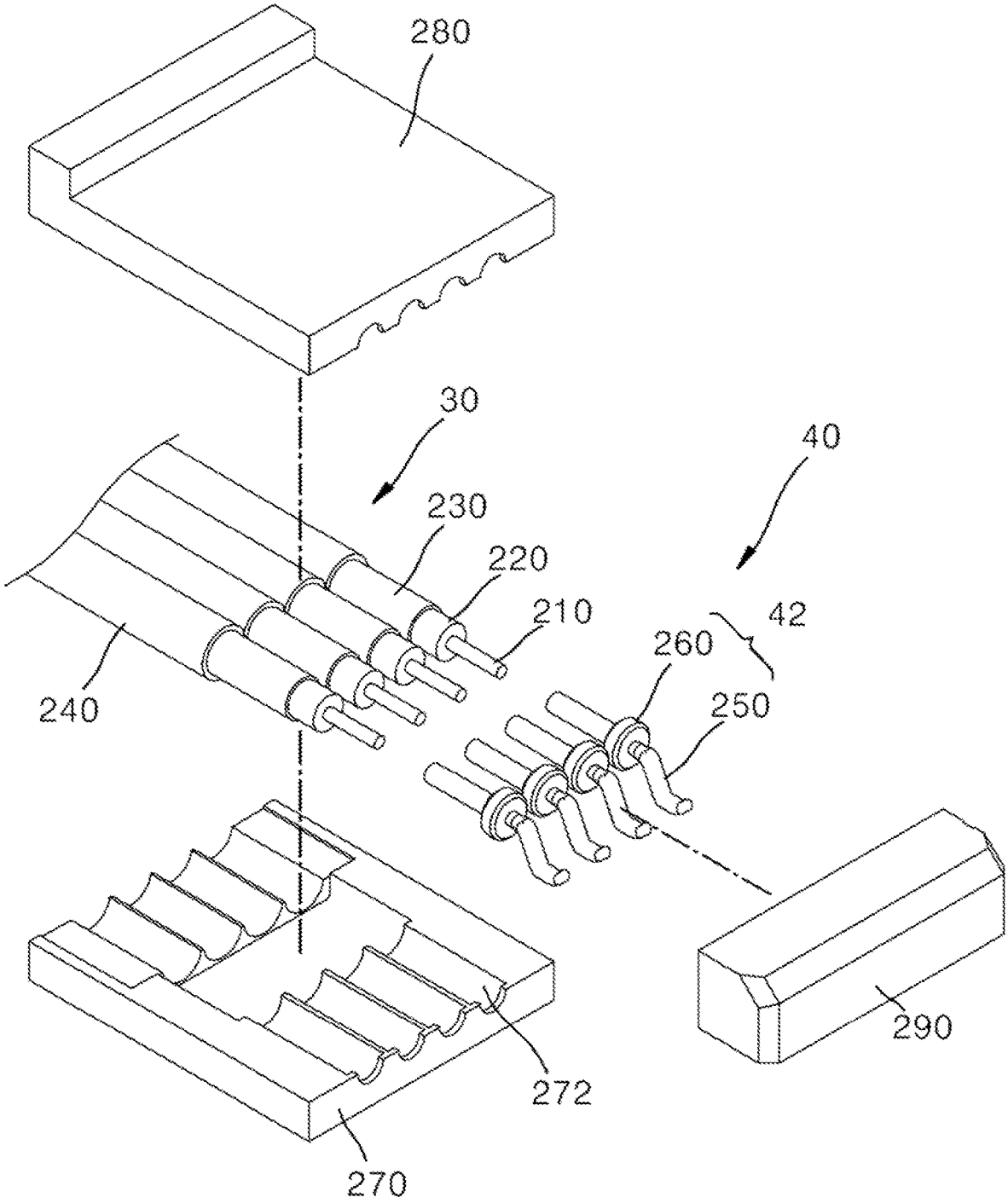
FIG. 7 is a view of multiple coaxial cables connected to the male connector of the compact connector for transmitting super-high frequency signals according to the present invention.

FIG. 7 is a view of exemplary components constituting the male connector 20 of the compact connector for transmitting super-high frequency signals according to the present invention. The male connector 20 of the compact connector for transmitting super-high frequency signals according to the present invention includes coaxial cables 30 and a shielding can 270, 280, 290 and may further include an adapter unit 40. The sheath 240, the outer conductor 230, and the dielectric 220 of the coaxial cable 30 are partially stripped. The outer conductors 130 of the coaxial cables 30 may be connected to the shielding can 270, 280, 290. The shielding can 270, 280, 290 receives, protects, and secures the coaxial cables 30 and blocks electromagnetic waves generated from the inner conductors 210 of the coaxial cables. The shielding can 270, 280, 290 may be formed by coupling a lower shielding member 270, an upper shielding member 280, and a front shielding member 290 to one another. However, it will be understood that the present invention is not limited thereto and at least two of the lower shielding member 270, the upper shielding member 280, and the front shielding member 290 may be integrally formed with one another, or the shielding can may be composed of one shielding member in which the lower shielding member 270, the upper shielding member 280, and the front shielding member 290 are integrally formed with one another.

The adapter unit 40 includes multiple adapters. Each of the adapters 42 is configured to be easily shielded by the shielding can 270, 280, 290 and to allow easy connection between the inner conductor 210 of the coaxial cable 30 and the circuit signal line terminal pad 214 formed on the PCB 215, and includes a conductor portion 250 and a dielectric portion 260. One end of the conductor portion 250 is brought into contact with and connected to the signal line terminal pad 214 on the PCB 215 and the other end of the conductor portion 250 receives and is connected to the signal line 210, that is, the inner conductor of the coaxial cable 30. When the inner conductor, that is, the signal line of the cable, is received in and connected to the adapter 42, the one end of the conductor portion 250, which corresponds to the cable signal line terminal 255 of FIG. 4, is brought into contact with and connected to the signal line terminal pad 214 on the PCB 215.

The dielectric portion 260 serves to separate the conductor portion 250 received in the shielding can 270, 280, 290 from the shielding can.

The shielding can 270, 280, 290 includes an adapter reception portion 272 formed therein and having cylindrical portions adapted to receive the adapters 42 one-to-one connected to the inner conductors 210 of the single or multiple coaxial cables, respectively. The adapter reception portion 272 is configured to form shielding walls adapted to separate the adapters received in the adapter reception portion from one another and to shield the adapters upon coupling of the lower shielding member 270 to the upper shielding member 280 and the front shielding member 290.

Figure 8:
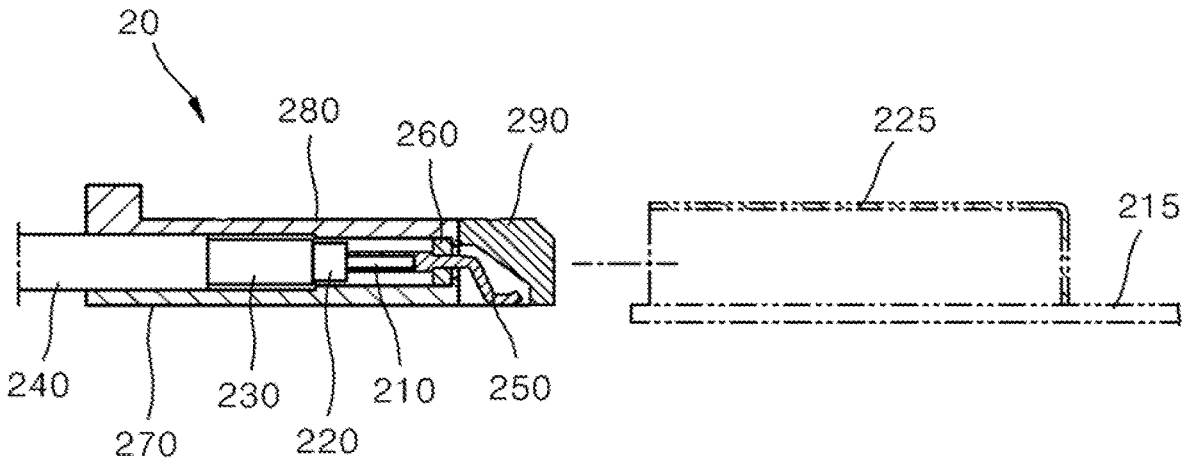
FIG. 8 is a sectional view of the male connector of FIG. 2, taken along line VII-VII.
Figure 9:
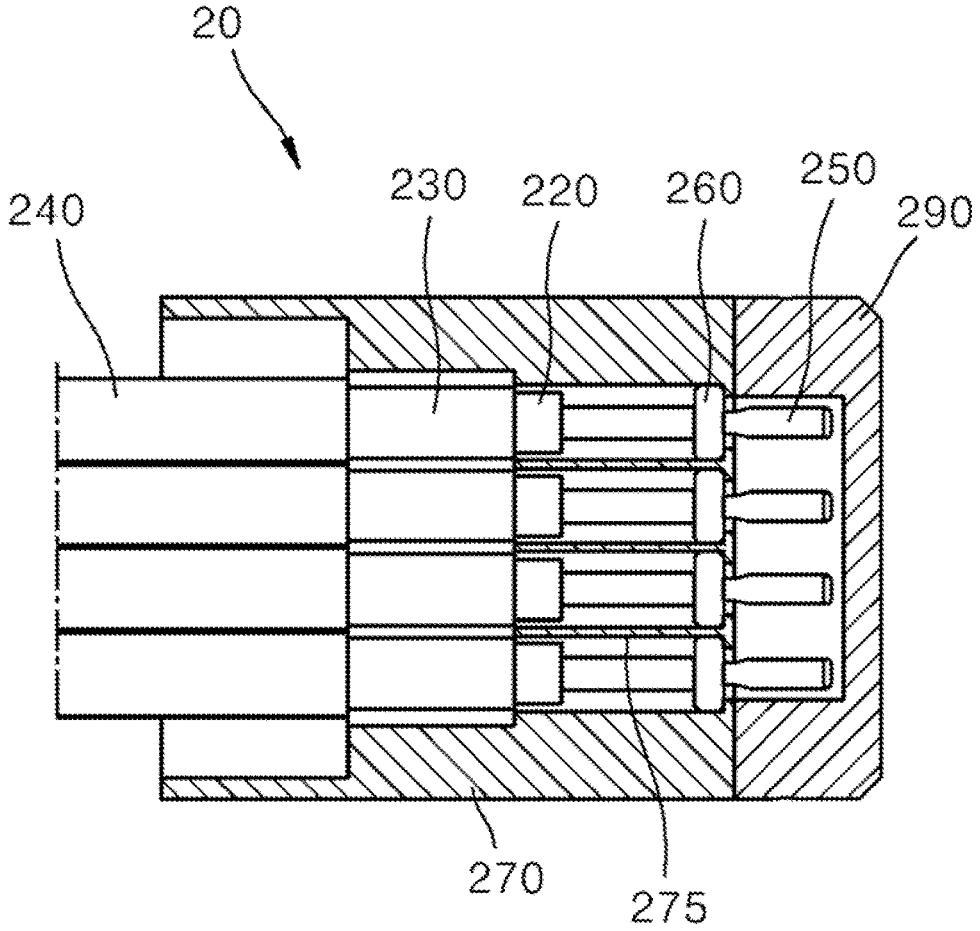
FIG. 9 is a sectional view of the male connector of FIG. 2, taken along line VIII-VIII.
Figure 10:
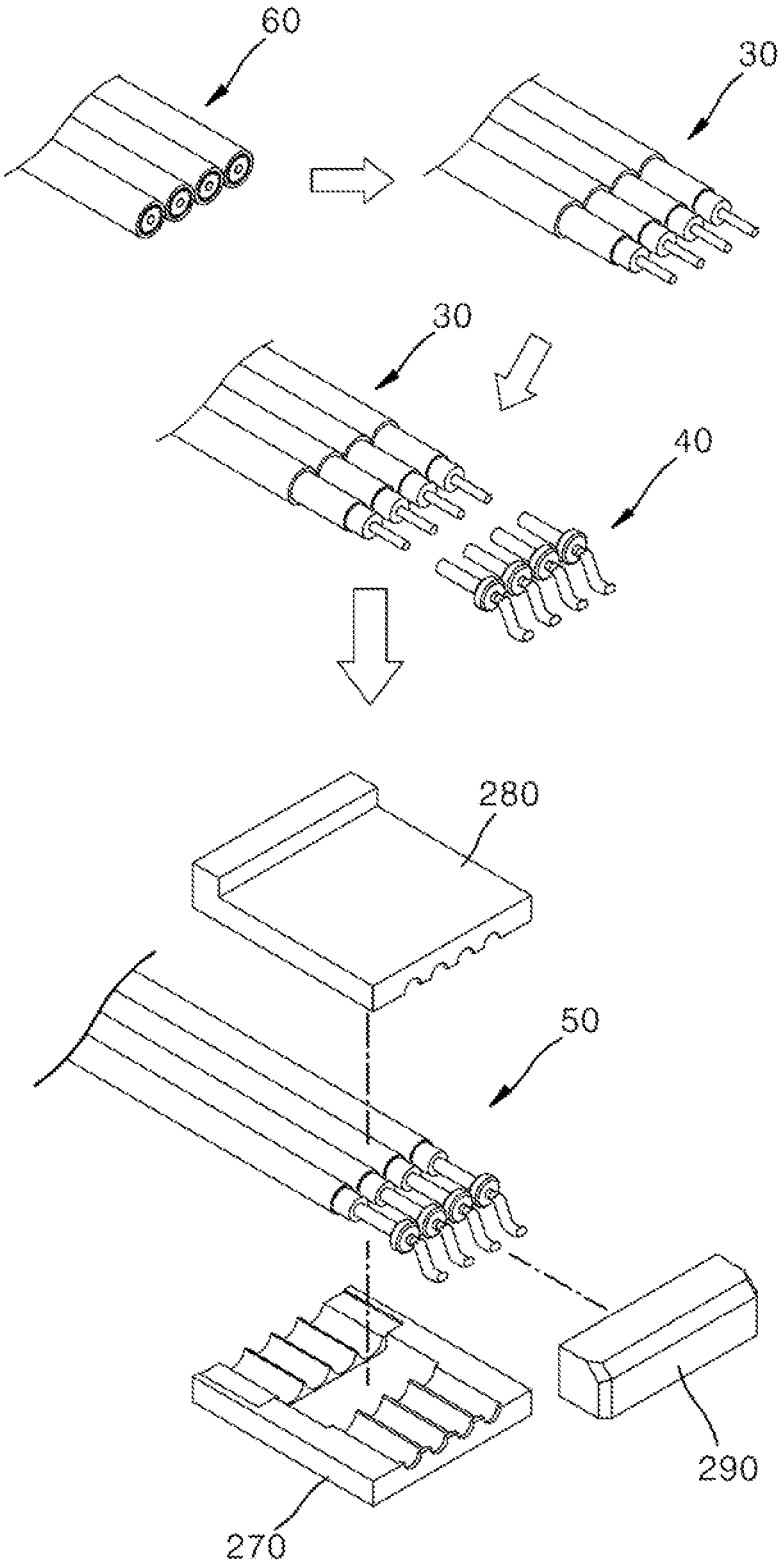
FIG. 10 is a view showing a process of assembling a male connector of a PCB multi-connector according to the present invention.

FIG. 8 is a sectional view of the male connector of FIG. 2, taken along line VII-VII, and FIG. 9 is a sectional view of the male connector of FIG. 2, taken along line VIII-VIII. Referring to FIG. 8 and FIG. 9, with the coaxial cables 210, 220, 230, 240 and the adapters 250, 260 received, protected and shielded by the shielding can 270, 280, 290, the male connector 20 is inserted into and fastened to the connector socket 225 mounted on the PCB 215. In particular, FIG. 9 shows the shielding walls 275 formed by coupling the lower shielding member 270, the upper shielding member 280, and the front shielding member 290 to one another, wherein the shielding walls separate the adapters from one another while shielding the adapters. FIG. 10 is a view showing a process of assembling the male connector of the compact multi-connector for transmitting super-high frequency signals according to the present invention. Referring to FIG. 10, unstripped coaxial cables 60 are stripped, followed by connecting the stripped coaxial cables 30 to the adapter unit 40, and then the coaxial cables 50 connected to the adapter unit 40 are seated on the lower shielding member 270, which, in turn, is coupled to the upper shielding member 280 and the front shielding member 290.

The compact connector for transmitting super-high frequency signals according to the present invention can provide maximized shielding against electromagnetic waves generated from signal lines when coaxial cables are used as the signal lines. Specifically, the shielding can 270, 280, 290 of the male connector 20 is connected to the outer conductors 230 of the coaxial cables 30. The connector socket 215 formed of a conductor is connected to a ground terminal of the PCB 215. When the male connector 20 is inserted into and fastened to the connector socket 225 mounted on the PCB 215, the shielding can 270, 280, 290 of the male connector 20 connected to the outer conductors 230 of the coaxial cables 30 is brought into contact with and connected to the connector socket 225 connected to the ground terminal of the PCB 215, thereby maximizing shielding effects against electromagnetic waves generated from the signal line terminals in the male connector, which directly contact the terminal pads 214 on the PCB 215, respectively.

Although some embodiments have been described herein with reference to the accompanying drawings, it should be understood by those skilled in the art that these embodiments are given by way of illustration only and that various modifications, variations, and alterations can be made by those skilled in the art without departing from the spirit and scope of the present invention. Therefore, the scope of the invention should be limited only by the accompanying claims and equivalents thereto.

<List of Reference numerals>

| | |
|---|---|
| 110: Male connector | 112: Male connector housing |
| 114: Electrical signal line | 150: Female connector |
| 152: Female connector housing | 154: Terminal (pin) reception member |
| 20: Male connector | 210: Inner conductor (signal line) |
| 214: PCB terminal pad | 215: Printed circuit board (PCB) |
| 220: Dielectric | 222: Fastening portion |
| 225: Connector socket | 230: Outer conductor (shielding layer) |
| 240: Sheath (jacket) | 250: Adapter conductor portion |
| 255: Cable signal line terminal | 260: Adapter dielectric portion |
| 270: Lower shielding member | 272: Adapter reception portion |
| 280: Upper shielding member | 290: Front shielding member |
| 30: Coaxial cable | 40: Adapter unit |
| 42: Adapter | 50: Coaxial cable connected to adapter |
| 60: Unstripped coaxial cable | |

What is claimed is:

1. A compact connector for transmitting super-high-frequency signals, which is adapted to connect a printed circuit board (PCB) to multiple super-high-frequency signal lines transmitting super-high frequency signals therethrough, the compact connector comprising:

a male connector connected to the multiple super-high-frequency signal lines and comprising a male connector housing receiving, securing, and protecting terminals of the multiple super-high frequency signal lines; and a connector socket mounted on the PCB and receiving the male connector housing to be fastened to the male connector, wherein the male connector further comprises adapters connected at one end thereof to the super high-frequency signal lines and at the other end thereof to signal line terminal pads formed on the PCB, and the super-high-frequency signal lines are connected to the signal line terminal pads on the printed circuit board via the adapter of the male connector, wherein the male connector housing is a shielding can blocking electromagnetic waves generated from the multiple super-high frequency signal lines, wherein the connector socket receives the shielding can of the male connector and is electrically connected to the shielding can and a ground terminal of the PCB, wherein the shielding can comprises an adapter reception portion receiving the adapters, the adapter reception portion being configured to form shielding walls adapted to individually shield the adapters, wherein the adapter comprises a conductor portion, and a dielectric portion which serves to separate the conductor portion from the shielding can, and wherein the shielding can entirely shields the rest of the adapters except for the portions in contact with the signal line terminal pads formed on the PCB.

2. The compact connector for transmitting super-high-frequency signals according to claim 1, wherein the connector socket further comprises a fastening portion to be fastened to the male connector.

3. The compact connector for transmitting super-high-frequency signals according to claim 1, wherein the connector socket is mounted on the PCB by surface-mount technology (SMT), through-hole-mount technology, such as single in-line package (SIP) technology, dual in-line package (DIP) technology, and quad in-line package (QIP) technology, or a combination of surface-mount technology and through-hole-mount technology.

4. The compact connector for transmitting super-high-frequency signals according to claim 1, wherein the connector socket is integrally formed with the PCB.

5. The compact connector for transmitting super-high-frequency signals according to claim 1, wherein the super-high frequency signal line comprises one selected from the group of a coaxial cable, a wire, a flexible flat cable (FFC), and a flexible printed circuit (FPC).

6. The compact connector for transmitting super-high-frequency signals according to claim 5, wherein the super-high frequency signal line comprises a combination of at least two selected from the group of a coaxial cable, a wire, a flexible flat cable (FFC), and a flexible printed circuit (FPC).

* * * * *